US006211357B1

(12) United States Patent
Owens et al.

(10) Patent No.: US 6,211,357 B1
(45) Date of Patent: Apr. 3, 2001

(54) STRENGTHENING COMPOSITIONS AND TREATMENTS FOR LIGNOCELLULOSIC MATERIALS

(75) Inventors: Blair Alex Owens, Fairfield; Dimitris Ioannis Collias, Mason; Andrew Julian Wnuk, Wyoming, all of OH (US)

(73) Assignee: Paper Technology Foundation, Inc., Kalamazoo, MI (US)

( * ) Notice: Subject to any disclaimer, the term of this patent is extended or adjusted under 35 U.S.C. 154(b) by 0 days.

(21) Appl. No.: 09/457,826

(22) Filed: Dec. 9, 1999

(51) Int. Cl.[7] ..... B05D 5/00
(52) U.S. Cl. ..... 536/59; 536/123.1
(58) Field of Search ..... 536/123.1, 59; 427/392

(56) References Cited

U.S. PATENT DOCUMENTS

| | | | | |
|---|---|---|---|---|
| 2,926,116 | | 2/1960 | Keim | 162/164 |
| 3,332,901 | | 7/1967 | Keim | 260/29.2 |
| 3,656,991 | | 4/1972 | Blackwell et al. | 117/33.3 |
| 3,849,184 | | 11/1974 | Roberts | 117/155 |
| 3,888,624 | | 6/1975 | Blackwell et al. | 8/21 |
| 3,982,993 | * | 9/1976 | Fife | 162/158 |
| 4,040,899 | | 8/1977 | Emerson | 162/13 |
| 4,191,610 | | 3/1980 | Prior | 162/147 |
| 4,240,935 | | 12/1980 | Dumas | 260/9 |
| 4,242,808 | | 1/1981 | Luthi | 34/23 |
| 4,520,048 | | 5/1985 | Ranger | 427/350 |
| 4,551,199 | | 11/1985 | Weldon | 162/109 |
| 4,588,616 | | 5/1986 | Menser | 427/430 |
| 4,702,943 | | 10/1987 | Long | 427/286 |
| 4,718,982 | | 1/1988 | Swenson et al. | 162/206 |
| 4,740,391 | | 4/1988 | Long | 427/286 |
| 4,826,555 | | 5/1989 | Long | 156/324 |
| 4,894,118 | | 1/1990 | Edwards et al. | 162/112 |
| 4,915,989 | | 4/1990 | Menser et al. | 427/434.2 |
| 4,919,758 | | 4/1990 | Wagle et al. | 162/175 |
| 4,936,920 | | 6/1990 | Keritsis et al. | 131/77 |
| 4,982,686 | | 1/1991 | Long | 118/406 |
| 5,097,764 | | 3/1992 | Waizmann | 101/425 |
| 5,120,773 | | 6/1992 | Fischer et al. | 523/400 |
| 5,210,958 | | 5/1993 | Bond et al. | 34/18 |
| 5,239,047 | | 8/1993 | Devere et al. | 528/339.3 |
| 5,242,545 | | 9/1993 | Bradway et al. | 162/135 |
| 5,338,404 | | 8/1994 | Lucas et al. | 162/163 |
| 5,378,497 | | 1/1995 | Johnson et al. | 427/211 |
| 5,456,800 | | 10/1995 | Tansley et al. | 162/158 |
| 5,510,004 | | 4/1996 | Allen | 162/168.2 |
| 5,585,456 | | 12/1996 | Dulaney et al. | 528/332 |
| 5,630,285 | | 5/1997 | Kerttula | 34/446 |
| 5,698,295 | | 12/1997 | Benner et al. | 428/182 |
| 5,776,546 | | 7/1998 | Long | 427/402 |
| 5,935,383 | | 8/1999 | Sun et al. | 162/158 |
| 6,114,471 | | 9/2000 | Owens et al. | 525/420 |

FOREIGN PATENT DOCUMENTS

| | | | |
|---|---|---|---|
| 0 418 015 A1 | | 3/1991 | (EP) . |
| 0 816 562 A2 | | 6/1998 | (EP) . |
| 50-076308 | * | 6/1975 | (JP) . |
| 56-101998 | * | 8/1981 | (JP) . |
| 1773925 | * | 11/1992 | (SU) . |
| WO 98/24974 | | 6/1998 | (WO) . |

OTHER PUBLICATIONS

Siegfried Fischer: "Pressure Impregnating of Decorative and Kraft Papers"; 1994; Plastic Laminates Symposium, p. 133–137.

William O. Kroeschell: "Bonding on the corrugator"; 1989; TAPPI, p. 67–72.

R. Nigel Jopson: "Saturation technology for corrugated containers"; Apr. 1993; Tappi Journal vol. 76, No. 4, p. 207–214.

Robert W. Hagemeyer et al.: "Pulp and Paper Manufacture, 3rd edition, vol. 6"; 1992; The Joint Textbook Committee of the Paper Industry, Tappi, CPPA, Montreal, Canada, p. 65–85 (H.H. Espy: "Wet–strength resins").

Database WPI–Section Ch, Week 199347: Derwent Publications Ltd., London, GB; Class A23, AN 1993–375856 XP 002128022 & SU 1 773 925A (Below Chem Articles Prodn Assoc), Nov. 7, 1992, abstract.

Database WPI–Section Ch, Week 197548: Derwent Publications Ltd., London, GB; Class A28, AN 1975–79396W XP 002128024 & JP 50 076308A (Sumitomo Chem Co Ltd), Jun. 23, 1975, abstract.

Database WPI–Section Ch, Week 199124: Derwent Publications Ltd., London, GB; Class A82, AN 1991–176285 XP 002128023 & SU 1 581 465A (Mariupol Metallurgy), Jul. 30, 1990, abstract.

* cited by examiner

*Primary Examiner*—Erma Cameron

(57) ABSTRACT

The strength of lignocellulosic materials is improved by treating them with water-soluble strengthening agents containing sulfonic units, and rendering these agents water-insoluble by reacting them with compounds containing epoxide rings and quaternary ammonium groups. Thus, a substantial reduction or elimination of the bleeding of said strengthening agents from the lignocellulosic materials when touched with wet hands or contacted under humid conditions is achieved.

4 Claims, No Drawings

STRENGTHENING COMPOSITIONS AND TREATMENTS FOR LIGNOCELLULOSIC MATERIALS

FIELD OF THE INVENTION

The present invention relates to products and processes to improve the strength of lignocellulosic materials.

BACKGROUND OF THE INVENTION

Lignocellulosic materials, such as paper and cardboard, can be strengthened by treating them (e.g. coating, impregnating, etc.) with solutions or dispersions of various strengthening agents. Examples of these solutions or dispersions are aqueous solutions of lignosulfonates. Lignosulfonates are metal or ammonium salts of lignosulfonic acids. The lignosulfonates are either by-products of the sulfite pulping process, or products of sulfonation of other lignin derivatives. Lignin derivatives include, but are not limited to, kraft lignin, organosolv lignin, chemically modified lignin derivatives, and mixtures thereof. However, one major problem with using these strengthening agents is that they bleed off the lignocellulosic materials when touched with wet hands. This results in poor aesthetics and increased messiness. Another major problem is that these strengthening agents exhibit low retention of strength at high humidity compared to that at normal humidity (e.g. 50% RH). Again, this problem is expected to be caused by their high affinity to water and moisture.

One common method to increase the strength of the lignocellulosic material under high humidity conditions is to add additional fiber to the material. However, this method is not cost effective as well because of the additional fiber/material costs. Another method to eliminate or reduce the bleeding of the water-soluble strengthening agents is to coat the treated lignocellulosic materials with wax or polymer films. However, this method is not an effective solution because the secondary coating materials are expensive to purchase, process, and apply, and typically not repulpable under normal conditions.

Yet another method to eliminate or reduce bleeding of the water-soluble strengthening agents is to insolubilize them by crosslinking. In the case of lignosulfonates the crosslinking reactions that have been reported in the literature include the following: condensation reaction with strong mineral acids at elevated temperatures (via the $SO_3^{2-}$ units), oxidative coupling reaction with hydrogen peroxide and catalysts (via the $OH^-$ groups), reaction with bis-diazonium salts (via the $\alpha$-position to the $OH^-$ groups), reaction with bifunctional acid chlorides (via the $OH^-$ groups), reaction with cyanuric chloride (via the $OH^-$ groups), reaction with formaldehyde (via the $CH_2$ groups), reaction with furfural (via the $\alpha$-position to the $OH^-$ groups), and reaction with epichlorohydrin (via the $OH^-$ groups). However, the above reactions/processes include various processing problems, such as cost, low pH, long reaction times, harsh conditions (e.g. temperature), health hazards, etc.

What has been missing is an inexpensive product and a simple, inexpensive, and fast process to improve the strength of treated lignocellulosic materials under humid conditions by reacting the water-soluble strengthening agents so as to substantially reduce or eliminate the bleeding of the water-soluble strengthening agents from the material when touched with wet hands or contacted under humid conditions.

SUMMARY OF THE INVENTION

The present invention relates to products and processes to improve the strength of lignocellulosic materials. The strength improvement is achieved by treating the lignocellulosic materials with water-soluble strengthening agents having at least one sulfonic unit and rendering these agents water-insoluble by reacting them with compounds having at least one epoxide ring and at least one quaternary ammonium group. This results in a substantial reduction or elimination of the bleeding problem of the originally water-soluble strengthening agents from the lignocellulosic materials when touched with wet hands or contacted under humid conditions.

DETAILED DESCRIPTION OF THE INVENTION

It is known that the strength of lignocellulosic materials (e.g. paper, linerboard, corrugated, cartonboard, etc.) can be improved by treating them with various aqueous solutions of strengthening agents (e.g. sodium silicate, starch, carboxy methyl cellulose—CMC, xylan, etc.). Unfortunately, these water-soluble strengthening agents bleed off the materials when touched by wet hands or contacted under humid conditions.

Lignosulfonates are water-soluble strengthening agents that can also be used to strengthen lignocellulosic materials. The lignosulfonates contain sulfonic units ($HSO_3^-$; also called hydrogen sulfite units) and sulfonate units ($SO_3^{2-}$; also called sulfite units), and for the purposes of this disclosure the term "sulfonic" will be used to encompass both "sulfonic" and "sulfonate" units. It is expected that the lignosulfonates strengthen the lignocellulosic materials by reinforcing their fibers and/or fiber bonds, via encapsulation and/or penetration. Lignosulfonates are examples of a variety of possible lignin derivatives which may be used. Lignin derivatives include, but are not limited to, kraft lignin, organosolv lignin, chemically modified lignin derivatives wherein the nucleophilic sulfonic unit is preserved, and mixtures thereof.

Unexpectedly it was found that an aqueous calcium lignosulfonate solution (LIGNOSITE 50 containing 40% calcium lignosulfonate and 10% inert solids; from Georgia-Pacific Inc.; Atlanta, Ga.) when mixed together with an aqueous polyamine polyamide epichlorohydrin resin containing epoxide rings and quaternary ammonium groups exhibits a virtually instantaneous reaction that results in a precipitate. This precipitate exhibits water-insoluble properties. This mixing is a simple, inexpensive, and fast process that is carried out under ambient conditions and without the need for complex pieces of equipment. It was also unexpectedly found that aqueous sodium lignosulfonate (LIGNOSITE 458 from Georgia-Pacific Inc.) and ammonium lignosulfonate (LIGNOSITE 1740 from Georgia-Pacific Inc.) when independently mixed together with an aqueous polyamine polyamide epichlorohydrin resin containing epoxide rings and quaternary ammonium groups exhibit a virtually instantaneous reaction that results in a precipitate.

One commercially available polyamine polyamide epichlorohydrin resin {also referred to as a) polyaminoamide epichlohydrin (PAE), b) poly(aminoamide) epichlorohydrin, c) amino polyamide epichlorohydrin, d) polyamide epichlorohydrin, e) amine polymer-epichlorohydrin (APE), and f) polyalkylenepolyamine-epichlorohydrin (PAPAE)} containing epoxide rings and quaternary ammonium groups is KYMENE (KYMENE 450 and KYMENE 2064, both containing 20% solids; from Hercules Inc.; Wilmington, Del.). For the purposes of this disclosure the term "KYMENE" shall refer to the class of polyamine polyamide epicholorhydrin resins containing epoxide rings and quaternary ammonium groups. KYMENE is a compound that is used as a wet-strength agent in paper applications. Preparation of KYMENE is described in great details in Keim, U.S. Pat. No. 3,700,623, issued Oct. 24, 1972; and Keim, U.S. Pat. No. 4,537,657, issued Aug. 27, 1985. Although it is known that KYMENE has a strong affinity for itself (as it crosslinks primarily with itself) and a slight affinity for cellulose or CMC (via the cellulose's carboxyl and hydroxy groups), it has never been disclosed or found that KYMENE has a strong affinity for lignosulfonates.

One commercial source of a useful polyamide polyamine epichlorohydrin compound containing epoxide rings and quaternary ammonium groups is Hercules, Inc. of Wilmington, Delaware, which markets such compound under the trademark KYMENE 450 and KYMENE 2064. As referenced in U.S. Pat. No. 4,537,657, KYMENE 450 polyamide polyamine epichlorohydrin wet-strength resin has the formula

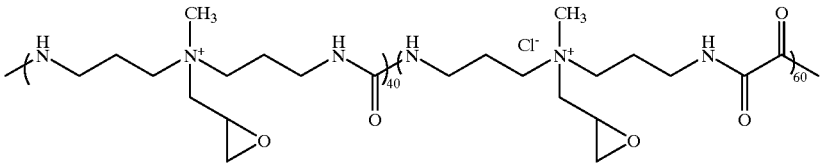

As referenced in U.S. Pat. No. 3,700,623, KYMENE 2064 polyamide polyamine epichlorohydrin wet-strength resin has the formula

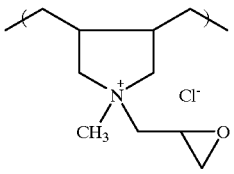

Another commercial source of a useful polyamide polyamine epichlorohydrin compound containing epoxide rings and quaternary ammonium groups is Ciba Specialty Chemical Corporation (High Point, N.C.), which markets such compound under the trademark RESICART-E.

Without wishing to be bound by theory, it is hypothesized that the crosslinking takes place between the highly nucleophilic sulfonic or sulfonate units of the lignosulfonate and the epoxide rings and quaternary ammonium groups of the polyamine polyamide epichlorohydrin resin. Furthermore, it is believed that 3-D molecular conformations, active unit (i.e., ring or group) spacings and charge density, and steric effects play important roles in determining the strength of the crosslinking association. These hypotheses were tested in various series of experiments.

In the first series, various lignosulfonate solutions were tested with KYMENE to determine which ones react similarly to LIGNOSITE 50. Out of the 20 lignosulfonate solutions supplied by Westvaco (Westvaco Inc., New York, N.Y.), Lignotech (Borregaard Lignotech Inc., Sarpsborg, Norway), and Georgia-Pacific only 16 (Westvaco's REAX 83A, Westvaco's REAX 85A, Westvaco's KRAFTSPERSE EDF450, Lignotech's WANIN S, Lignotech's UFOXANE 3A, Lignotech's NORLIG G, Lignotech's NORLIG A, Lignotech's MARASPERSE N-22, Lignotech's MARASPERSE N-3, Lignotech's MARASPERSE AG, Lignotech's MARASPERSE CBA-1, Lignotech's WELLTEX 200, Lignotech's WELLTEX 300, Lignotech's WELLTEX 300F, Georgia-Pacific's LIGNOSITE 1740, and Georgia-Pacific's LIGNOSITE 458) formed a precipitate similar to that of LIGNOSITE 50. Finally, kraft lignin (INDULIN AT from Westvaco Inc.), which has hydroxyl but not sulfonic/sulfonate units, could not form a precipitate with KYMENE. Polystyrene sulfonate (from Aldrich Inc., Milwaukee, Wis.), which has sulfonic but not hydroxyl units, was combined with KYMENE and resulted in a precipitate. However, polyvinyl sulfonate (from Aldrich Inc.) did not form a precipitate when combined with KYMENE. All the above experiments point to the fact that the existence of the sulfonic/sulfonate units in a compound is a necessary but not a sufficient condition for a reaction between this compound and KYMENE to form a precipitate.

In another series of experiments, polydiallyldimethylammonium chloride (i.e., PDADMAC; molecular weight of 100,000 to 200,000), that has quaternary ammonium groups but not epoxide rings, was mixed with lignosulfonate. The resulting product was a thickened slurry of the two polymeric compounds, unlike the precipitate between lignosulfonate and KYMENE. Furthermore, other polymeric amines, such as polyethylenimine (PEI), were mixed with lignosulfonate and produced a similar water-soluble thickened slurry. Similarly, an epoxy/hydroxy functionalized polybutadiene (CAS# 129288-65-9; molecular weight of about 2,600), that does not contain quaternary ammonium groups, was mixed with lignosulfonate. Unlike the precipitate formed between lignosulfonate and KYMENE, no precipitate was formed between the two components.

It was also discovered that the precipitate between lignosulfonate and KYMENE will only stay water-insoluble within a certain pH range. More specifically, it was discovered that certain alkaline conditions, which may be dependent upon the compounds reacted, will solubilize the precipitate. For example, the precipitate from the reaction of calcium lignosulfonate (LIGNOSITE 50 from Georgia-Pacific Inc.) and KYMENE 450 (from Hercules Inc.) will solubilize in a water solution if the pH is about 11 or higher.

This crosslinking reaction and treatment can be applied to the lignocellulosic materials at any stage of the material manufacturing process, including the pulp stage, wet end of the paper making process (e.g. in the headbox, or formation section, or press section), and dry end (e.g. in the drying section or size press), or even to dry material already processed (e.g. linerboard, and medium) and formed into final products (e.g. corrugated board). In general, there are two methods to form the precipitate and apply it to the lignocellulosic materials.

In the first method, the precipitate is formed in the lignocellulosic material (also called in-situ method) and in the second method the precipitate is pre-formed and then applied to the lignocellulosic material. In one variation of the in-situ method, the water-soluble strengthening agent having at least one nucleophilic sulfonic unit is applied to the lignocellulosic material first and the compound having at least one epoxide ring and at least one quaternary ammonium group is applied second. In another variation of the in-situ method, the compound having at least one epoxide ring and at least one quaternary ammonium group is applied to the lignocellulosic material first, and the water-soluble strengthening agent having at least one nucleophilic sulfonic unit is applied second. Various methods may be used to apply both the compound having at least one epoxide ring and at least one quaternary ammonium group and the water-soluble strengthening agent having at least one nucleophilic sulfonic unit. Such methods of application include, but are not limited to, immersion, coating, and incorporation by pressure (e.g. MIPLY pressure saturation method; U.S. Pat. No. 4,588,616 herein incorporated by reference). The chosen method to apply the compound having at least one epoxide ring and at least one quaternary ammonium group need not be the same as the chosen method to apply the water-soluble strengthening agent having at least one nucleophilic sulfonic unit.

The in-situ method can be used for a single lignocellulosic material as well as for a laminate structure of plies of lignocellulosic materials. In the latter case, the compound containing the sulfonic units and the compound containing the epoxide rings and quaternary ammonium groups can be applied on the same ply or on two subsequent plies or between two plies. Note that when the compound containing the sulfonic units is applied to one ply and the compound containing the epoxide rings and quaternary ammonium groups is applied to the subsequent ply, the precipitate that is formed between the plies performs well as a water-resistant adhesive.

In the second method, the precipitate is formed first by mixing a compound having at least one epoxide ring and at least one quaternary ammonium group and a water-soluble strengthening agent having at least one nucleophilic sulfonic unit and then it is applied to a lignocellulosic material. Similarly to the in-situ method, this method can be used for a single lignocellulosic material as well as for a laminate structure of plies of lignocellulosic materials. In the latter case, the precipitate can be applied to a single ply or between two plies. Note that when the precipitate is applied between two plies, it also performs well as a water-resistant adhesive.

Lignosulfonate may be used in either solid form (e.g. powder) or liquid form (e.g. solution or dispersion in water, or mixtures of water and organic solvents). For example, lignosulfonate powder (e.g. LIGNOSITE 100 from Georgia-Pacific) can be mixed with an aqueous KYMENE solution and result in a precipitate, similar to the precipitate resulting from the mixture of lignosulfonate and KYMENE solutions. Similarly, the KYMENE can be used either in the solid form (e.g. powder) or liquid form (e.g. solution or dispersion in water, or mixtures of water and organic solvents).

In general, the solvent or dispersant of the solution or dispersion of the strengthening agents may or may not contain water, i.e., it can be totally aqueous, or totally organic, or it can contain mixtures of water and organic solvents. Furthermore, the strengthening agents can be in pure form or in mixtures with other inert or active agents.

The substantial reduction or elimination of bleeding of lignosulfonate from lignosulfonate-KYMENE treated paper, as well as the high retention of strength in high humidity for lignosulfonate-KYMENE treated paper are is shown in the following two examples.

EXAMPLE 1

The elimination of bleeding is checked by submerging paper samples in water for a period of several days. Two sets of samples are prepared. The first set of samples are made using 35# linerboard (i.e., 35 pounds per thousand square feet; 35 lb/msf; 170 g/m$^2$ or 170 grams per square meter; product USP70 from Georgia-Pacific Inc.) dipped into an aqueous solution of calcium lignosulfonate (LIGNOSITE 50 from Georgia-Pacific Inc.; 40% lignosulfonate solids and 10% inert solids) for 1 minute. The second set of samples are made using 35# linerboard dipped first into an aqueous solution of calcium lignosulfonate for 1 minute, then wiped free of excess aqueous solution, and then dipped into an aqueous solution of 5.0% KYMENE 450 (from Hercules Inc.) for 10 seconds. Both sets of samples are dried between two heated platens at 177° C. for 10 seconds. Both sets of samples are then submerged in water at room temperature for a period of at least three days. The water around the lignosulfonate treated samples turns dark brown indicating that amounts of lignosulfonate bleed from the samples. However, the water around the lignosulfonate-KYMENE treated samples remains clear indicating that no lignosulfonate bleeds from the samples.

EXAMPLE 2

In an experiment designed to determine the humidity resistance of lignosulfonate-KYMENE treated linerboard at 80% RH, 35# linerboard (product USP70 from Georgia-Pacific Inc.) is first treated with calcium lignosulfonate and then treated with KYMENE as in Example 1. The strength of this lignosulfonate-KYMENE treated linerboard is then tested by conducting a Ring Crush test (RCT; TAPPI standard T822-om93). The RCT test value is about 5% to 10% higher than that of the same linerboard treated with calcium lignosulfonate only (as in Example 1). This difference in RCT values is statistically significant.

We claim:

1. A product in lignocellulosic material, said product comprising a precipitate of:

a) a water-soluble strengthening agent having at least one nucleophilic sulfonic unit; and b) a compound having at least one epoxide ring and at least one quaternary ammonium group, said precipitate reducing bleeding of said strengthening agent from said lignocellulosic material.

2. A product according to claim 1, wherein said water-soluble strengthening agent is selected from the group consisting of lignin derivatives and mixtures thereof.

3. A product according to claim 2, wherein said lignin derivatives is selected from the group consisting of metal salts of lignosulfonic acid, ammonium salts of lignosulfonic acid, and any further chemically modified lignin derivatives wherein the nucleophilic sulfonic unit is preserved, and mixtures thereof.

4. A product according to claim 1, wherein said compound having at least one epoxide ring and at least one quaternary ammonium group is selected from the group consisting of polyamide-polyamine-epichlorohydrin compounds and mixtures thereof.

* * * * *